US005550567A

United States Patent [19]

Baillif

[11] Patent Number: 5,550,567

[45] Date of Patent: Aug. 27, 1996

[54] DATA INPUT/OUTPUT DEVICE FOR DISPLAYING INFORMATION, AND METHOD FOR EMPLOYING SUCH A DEVICE

[75] Inventor: Christian Baillif, Bourg La Reine, France

[73] Assignee: Bull S.A., Paris, France

[21] Appl. No.: 291,832

[22] Filed: Aug. 17, 1994

Related U.S. Application Data

[63] Continuation of Ser. No. 053,311, Apr. 28, 1993, abandoned, which is a continuation of Ser. No. 731,699, Jul. 18, 1991, abandoned.

[30] Foreign Application Priority Data

Jul. 23, 1990 [FR] France ..... 90.09363

[51] Int. Cl.[6] ..... G09G 3/00

[52] U.S. Cl. ..... 345/203; 345/200; 345/206

[58] Field of Search ..... 345/202, 203, 345/200, 189, 190, 191, 192, 193, 206

[56] References Cited

U.S. PATENT DOCUMENTS

| | | | |
|---|---|---|---|
| 4,368,461 | 1/1983 | Komatsu et al. | 345/192 |
| 4,435,779 | 3/1984 | Mayer et al. | 345/203 |
| 4,486,856 | 12/1984 | Heckel et al. . | |
| 4,677,432 | 6/1987 | Maeda et al. | 340/750 |
| 4,688,190 | 8/1987 | Bechtolsheim | 340/799 |
| 4,742,350 | 5/1988 | Ko et al. | 340/799 |
| 4,783,650 | 11/1988 | Bugg | 345/192 |
| 4,783,652 | 11/1988 | Lumelsky | 340/750 |
| 4,851,834 | 7/1989 | Stockebrand et al. | 340/798 |
| 4,862,150 | 8/1989 | Katsura et al. | 340/798 |
| 4,873,652 | 10/1989 | Pilat et al. | 340/750 |
| 4,935,880 | 6/1990 | Kelleher et al. | 340/799 |
| 5,003,304 | 3/1991 | Takinomi et al. | 340/801 |
| 5,150,462 | 9/1992 | Takeda et al. | 340/798 |
| 5,185,859 | 2/1993 | Gutlag et al. | 340/798 |

FOREIGN PATENT DOCUMENTS

| | | |
|---|---|---|
| 0077560 | 10/1982 | European Pat. Off. . |
| 0139356 | 8/1984 | European Pat. Off. . |
| 3138930 | 9/1981 | Germany . |

OTHER PUBLICATIONS

*Editions Radio*, "Interfaces Pour Microprocesseurs Et Micro–Ordinateurs" by H. Lilen, pp. 24 & 25; 1983.

*Primary Examiner*—Tommy P. Chin
*Assistant Examiner*—A. Au
*Attorney, Agent, or Firm*—Edward J. Kondracki; Kerkam, Stowell, Kondracki & Clarke, P.C.

[57] ABSTRACT

Data input/output device for the display of information which is monolithically integrated in an application specific integrated circuit (ASIC). The device is principally constituted by a single memory which is divided into specific zones for the programs, the screen and the character generator. Access to the various specific zones is authorized by a single-memory bus line MB and is administered in accordance with a sequencing method provided by a microprogrammed sequencer programmed for flow regulation. Various devices can be added to the ASIC to make it possible to fully utilize the pass band of the memory, such as cache memory (CM), a FIFO register (FR), and line buffer registers (RB).

16 Claims, 2 Drawing Sheets

DATA INPUT/OUTPUT DEVICE FOR DISPLAYING INFORMATION, AND METHOD FOR EMPLOYING SUCH A DEVICE

This is a continuation of application Ser. No. 08/053,311, filed Apr. 28, 1993, now abandoned, which is a continuation of 07/731,699 filed Jul. 18, 1991, now abandoned.

FIELD OF THE INVENTION

The present invention relates to a data input/output device for displaying information on a screen, developed on the basis of a microprocessor that on the one hand cooperates by means of a plurality of bus lines with memorizing means assigned to the microprocessor programs, and on the other cooperates with the video portion by way of memorizing means dedicated to the video screen and memorizing means assigned to a character generator.

It also relates to a sequencing method for distributing the memory cycles and regulating the flow of data inside the memorizing means of the device.

BACKGROUND OF THE INVENTION

Traditionally, such a data input/output device for displaying information on a screen, also currently known as a terminal, includes specific memories allocated or dedicated to the programs, to the screen, and to the character generator or generators. Each specific memory is then connected to the bus system by means of a bus specific to it.

However, selecting this kind of terminal architecture has some disadvantages. The cost of memories is a major factor in the price of a terminal, particularly for low-end character-mode terminals. Moreover, a desire for miniaturization must be acknowledged, and the known version is objectively unable to aid in reducing the bulk of the terminal. Furthermore, architecture with a plurality of memories, which requires the use of a plurality of buses, offers less flexibility in dimensioning and distributing the various functions.

OBJECT AND SUMMARY OF THE INVENTION

The present invention has the object of overcoming these various disadvantages and proposes a device of the aforementioned generic type which has a very substantial reduction in cost and offers both great flexibility in use and high power.

To achieve this, the device referred to at the outset is notable by being monolithically integrated in a specific application circuit, while the various memorizing means referred to above are primarily constituted by a single memory, in which specific zones with respect to the programs, screen and character generator have been allocated to store the information to which access is desired. Access to the various specific zones is authorized by a single-memory bus line and is administered by a sequencing method employed by microprogrammed sequencing means.

Thus the concept of the invention supports a trend toward a concept of a uniform memory by the choice of an architecture with a single-memory bus, thus offering greater flexibility in dimensioning and distribution of the screen administration, character fonts and program functions. The functionalities of the terminal are in fact expanded; for example, upon leaving the memory bus of the circuit, the option exists of increasing the memory capacity, in order to expand the character set, increase the number of screens memorized by the terminal, and so forth.

In addition, by realizing a low-end terminal by integration in the same circuit, it is possible to significantly lower the cost.

Finally, this type of device can be used for any family of terminals where the functionalities depend on the capacity and type (read-only memory, read/write memory) of memory blocks, such as a read-only memory character generator, the capability of fully or partially loading the character generator, making windows in the image (which is a function of the read/write memory zone capacity on the screen), extending the scatter chart, and so forth.

The device according to the invention is notable in that the memorizing means include a small-sized cache memory, associated with the single memory and inserted between the microprocessor and the single-memory bus line; in that case the preponderant parameter is the size of a line. This improves the success rate, and if a line of the cache memory is loaded with a single access to the specific memory zone, it is possible to obtain a significant reduction in the load due to the microprocessor in the specific memory zone.

The device according to the invention is notable in that the memorizing means further include a register of the first-in, first-out type, inserted between the video portion and the single-memory bus line. Introducing a register of the first-in/first-out type, or FIFO register, makes it possible to spread out the accesses over the full duration of a video line. The size of the FIFO register, in other words the number of words that it can contain, should be selected as large enough that accesses to the character generator use all of the pass band of the single memory. The specific memory zone assigned to the character generator is shared between the video and the microprocessor. Thus in the present case, the object of using a FIFO register is not only to shorten the cycle time of the single memory, but also to better use its pass band.

In a notable characteristic of the present device, the first-in/first-out register also furnishes three indications relating to its state: register full, register empty or nearly empty, and number of words in the register less than W, W being the number of words that must be accumulated in the register to be capable of meeting all the requests of the microprocessor during the useful portion of the video portion line scanning. Thus a cycle cannot be assigned immediately to the microprocessor except on the condition that the FIFO register is not empty. The empty FIFO register situation occurs only either at the beginning of a line that introduces a delay that is equal in duration to the cycle time of the single memory in the microprocessor cycle; or if the microprocessor has n accesses available, when it requires an (n+1)th access, this cycle is then deferred until the end of the line.

The device according to the invention is furthermore notable in that the memorizing means include at least two line buffer registers inserted between the video portion and the single-memory bus line.

If the character cell has L lines, then the word (attribute+character) is read L times. By using line buffer registers to memorize a row of characters, it is sufficient to spread out the load on such a register over the entire duration of display of a row (L television lines) and to have two of these registers, one of them being used for the video while the other is loading.

In an essential characteristic of the device according to the invention, the distribution of the memory cycles and regulation of the flow within the memory means are advantageously obtained by employing a sequencing method. This sequencing method is notable in that the allocation of a memory cycle is achieved in synchronism with the line scanning frequency of the video portion and is decided subsequent to a series of tests intended to determine the priority for executing the various tasks, in particular sampling in the specific zone of the memory assigned to the screen for loading the line buffer registers, the presentation of a word of the specific memory zone assigned to the character generator to the first-in/first-out register, or any request for access to the specific zone for the programs by the microprocessor, to the specific zone for the screen by the line buffer registers, or to the specific zone assigned to the character generator for the first-in/first-out register.

According to this method, allocation of the memory cycles is decided following a series of tests that on the one hand take into account the requests of the microprocessor and the access quota assigned to it, the character generator and the line buffer registers, and on the other hand the three indications relating to filling of the FIFO register, and finally the state of a counter associated with accesses by the microcomputer. The test results are utilized in the following manner:

if the first-in/first-out register is empty or nearly empty, the loading of this register has priority;

if the first-in/first-out register is not empty or nearly empty, accesses by the microprocessor have priority, as long as the access quota assigned to the microprocessor has not been exhausted, knowing furthermore that a cycle is not accounted for in this quota unless the line buffer registers are not full;

filling of the line buffer registers will have priority with respect to filling of the first-in/first-out register, if the number of words in the queue in this latter register is greater than W, or if the quota assigned to the microprocessor has been exhausted and if additionally the first-in/first-out register is not empty or nearly empty.

Thus in the device according to the invention, this method makes it possible to administer a plurality of memories or memory zones without slowing down the system, hence utilizing the capacity of the microprocessor and of the video the entire time, i.e., without disturbing them by any other task.

The following description given by way of example, taken in conjunction with the drawings, will enable better comprehension of how the invention can be achieved.

DESCRIPTION OF THE PREFERRED EMBODIMENT

Figure 1:
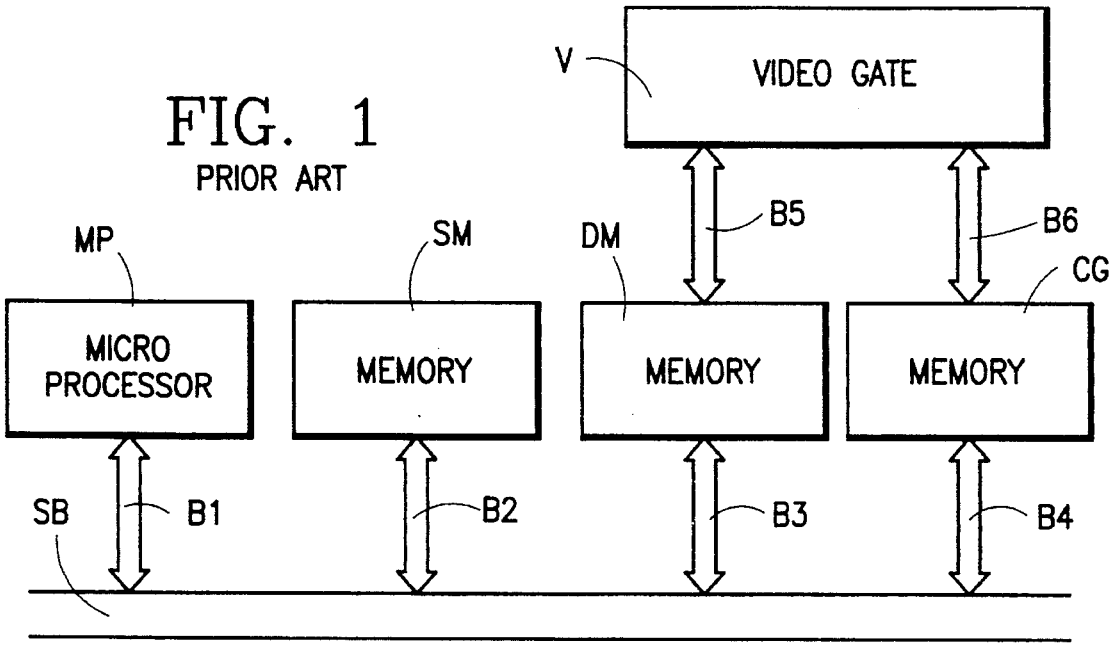
FIG. 1 PRIOR ART
FIG. 1 is a schematic view of a device according to the prior art.

FIG. 1 provides a schematic view of a data input/output device for display on a screen that permits a synthetic and practical view of the known prior art. This prior art device is designed around a microprocessor MP that by means of a plurality of bus lines SB (system bus) and B1—B6 cooperates with memorizing means SM assigned to the programs of the microprocessor (for example, a system read/write memory), on the one hand, and on the other with the video terminal V, by way of memorizing means DM assigned to the screen (for instance a read/write screen memory) and memorizing means (CG) assigned to a character generator (for instance, a read only memory).

Figure 2:
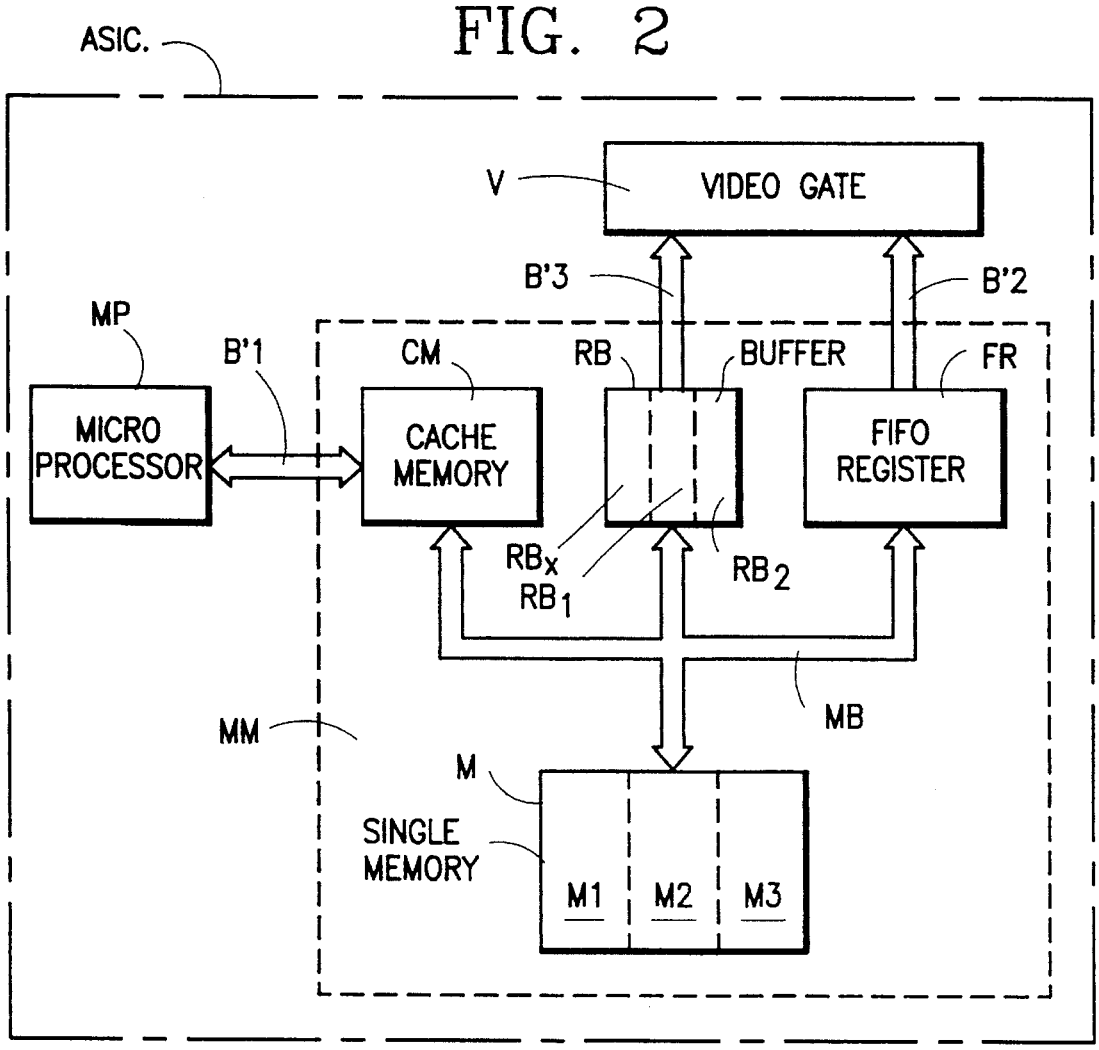
FIG. 2 proposes a schematic view of the device according to the invention.

FIG. 2 proposes a schematic view of the device which according to the invention is monolithically integrated in a specific application circuit (ASIC). The various memorizing means MM are constituted primarily by a single memory M in which specific zones relating to the programs, the screen and the character generator have been allocated for storage of the information to which access is desired. Access to the various specific zones is authorized by a single-memory bus line MB and is administered by a sequencing method that will be described in conjunction with FIG. 3 and which is employed by microprogrammed sequencing means that are included, for the sake of simplification, in the environment of the microprocessor identified as MP.

In one of the characteristics of the device, the memorizing means include a cache memory CM of small size, which is advantageously inserted between the microprocessor MP and the single-memory bus line MB. This brings about a significant reduction in the load occasioned by the microprocessor MP on the memory M, on the condition that a line of the cache memory CM will be loaded with only a single access to the memory, or in other words with a 16-bit memory for an eight-bit microprocessor, for example. The link between the cache memory CM and the microprocessor MP is obtained by way of the bus line B'1.

Another solution could consist in using a 16-bit microprocessor.

Also characteristically, the memorizing means include a register FR of the first-in/first-out type, inserted between the video terminal V (bus line B'2) and the memory bus line MB. The register FR also furnishes three indications relating to its state:

register full register empty or nearly empty number of words in the register less than W, W being the number of words that must be accumulated in the register to enable meeting all the requests of the microprocessor during the useful portion of the video portion line scanning.

Taking for example distribution of the following accesses, 132 accesses followed by an idle time corresponding to the line return, the introduction of the register FR makes it possible to spread out these accesses over the entire duration of a video line, hence 32 μs for example. In this example, the mean access time tm is accordingly 242 ns.

Assuming a format of 132 characters per row, the character matrix is nine dots in width. If the duration of a dot is 19 ns, this makes it possible to generate an access to the zone assigned to the character generator every 171 ns. The size of the register FR can thus be determined, taking the access distribution example (132 accesses) mentioned above as follows:

$$\text{size of } FR = \frac{(tm - 171)}{tm} \cdot 132 < 40 \text{ words.}$$

By selecting a register FR with at least 40 words, the cycle time of the memory may be 240 ns. Accesses assigned to the zone of the character generator thus use the entire pass band of the memory. Knowing that the memory zone assigned to the character generator is shared between the video and the microprocessor, it will be appreciated that the main advantage in using the register FR is not to shorten the cycle time of the memory but rather to better use its pass band.

If there were no register FR, then the microprocessor would have to wait for the line return because during the useful portion of the video, character generation monopolizes 100% of the memory, and hence is unable to use the available memory cycles in totality.

When a register of the FIFO type, such as FR, is used, its size is limited by the number of cycles n that can be anticipated (the number n is equal to the ratio between the duration of the line return and the cycle time of the memory) and by the number of cycles n' that the microprocessor can sequester or recover for itself during the useful portion of the video (the number n' is equal to the ratio between the duration of the useful portion of the video and the microprocessor access time). The size of the register FR is preferably selected to be equal to the number n'>40.

The microprocessor has n accesses every 32 μs. A cycle can be allocated immediately to it, on the sole condition that the register FR is not empty. The empty FIFO register situation occurs only at the beginning of a line, introducing a delay of 171 ns into the microprocessor cycle, or only when the microprocessor attempts a (n+1)th access, this cycle being deferred until the end of the line.

Another solution could comprise using a faster memory, that would make it possible to meet the needs of the microprocessor, but such a memory would be more expensive.

Finally, in a characteristic of the device of the invention, the memorization means further include at least two line buffer registers $RB_1$, $RB_2$. . . $RB_x$ schematically designated by dash lines. The RB registers are inserted between the video gate V (bus line B'3) and the single-memory bus line MB.

As has been seen above, if the character cell has L lines, then the word (attribute plus character) is read L times. To spread out the load of a buffer register over the entire display of one row (L television lines), it suffices to have two buffer registers, one used by the video and the other in loading.

However, during the passage of at least a portion of the image, at least two rows are not displayed completely, which shortens the time allotted to loading of a register RB.

In the extreme case, the cells united, and a row is displayed only during one television line. This leaves only 32 μs to reload a register RB. If the memory cannot furnish 132 words, then interference appears on the screen. A third line buffer register makes it possible to overcome this problem. The passage of a strip of X character rows consumes (X+1) rows, and the third register makes it possible to constitute a reserve of one row, which will be used up in the first strip moving past.

When several strips are currently moving past, the case is even more critical if on the one hand each strip has the size of one cell (L lines) and on the other hand all the strips are moving past. In terms of the display of each strip, this case, which has a low likelihood of occurring, results in using up the contents of two line buffer registers. One solution to this problem consists in providing a system with four line buffer registers, two of which are loaded during the display of one strip.

When one wishes to have a window appear on the screen, then from the standpoint of the number of accesses to the memory, and if sampling of the background characters enclosed by the window in the memory zone assigned to the screen is to be avoided, there is not any more constraint than in the case of a strip. Nevertheless, to avoid sampling the words (character+attribute), there is no need to have field attribute propagation.

However, the management of this kind of partitioning is more complicated, and one solution is advantageously to double the number of line buffer registers, by thus assigning one set of two registers for the background of the screen, and another set of two registers for the window.

Furthermore, a system with four line buffer registers makes it possible to markedly lower the rate induced by reading of the memory zone assigned to the screen, while authorizing sophisticated display modes.

Thus sharing of a memory between the microprocessor, reading of the character generator and reading of the zone assigned to the screen assumes optimal utilization of the pass band of this memory. However, good distribution of access and thus of memory cycles and regulation of the flow are necessary, and will advantageously be employed by means of a sequencing method. This method is notable in that the allocation of a memory cycle is done in synchronism with the line scanning frequency of the video terminal and is decided subsequent to a series of tests intended to determine the priority for performing the various tasks, in particular sampling in the specific zone of the memory assigned to the screen to load the line buffer registers, presentation of a word from the specific zone of the memory assigned to the character generator to the first-in/first-out register, or any request for access by the microprocessor to the specific zone for the programs, by line buffer registers to the specific zone for the screen, or by the first-in/first-out register to the specific zone assigned to the character generator, respectively.

According to this method, allocation of the memory cycles is decided following a series of tests that take into account on the one hand requests by the microprocessor and the access quota allocated to it, the character generator, and line buffer registers, and on the other hand the three indications relating to filling of the first-in/first-out register, and finally the state of a counter associated with access by the microprocessor.

When the memory is not oversized, as is the case for the device according to the invention which is intended to be less bulky, the basic rules for flow regulation are as follows:

accesses by the line buffer registers can be spread out over the entirety of a line, since the distribution is of no importance.

accesses by the character generator can be spread out, but the FIFO register must never be empty.

accesses by the microprocessor must be furnished as soon as possible, to minimize the number of queues. In the case of an overload, the microprocessor is the only device that can wait. The distribution of the microprocessor requests is not well controlled.

Generally, the FIFO register must never be empty; a reserve of two words is indispensable. The indication, FIFO empty or nearly empty, is a warning signal that must make filling of this register have priority.

Similarly, it is essential to guarantee loading of the line buffer registers while impeding the microprocessor as little as possible. Similarly and ideally, the rhythm for filling the line buffer registers depends on the state of the FIFO register, and in particular on the number of words in a queue in the latter register and on the utilization to be made of them.

To guarantee loading of the line buffer registers in the limiting case where the pass band of the memory is insufficient, the number of accesses allocated to the microprocessor must be reduced. Thus the access quota allocated to the microprocessor is determined as a function of the filling of the line buffer registers, which in turn depends on the state of the FIFO register. The quota is fixed for one time slot, which in our above example is 32 μs.

Two methods advantageously present themselves for solving the problem of fixation of the microprocessor quota.

In a first method, this quota, once determined, remains valid until the first-in/first-out register is full, or a lower quota is required to guarantee loading of the line buffer registers; upon each line return, the quota, which is determined as a function of the first-in/first-out register, becomes the effective quota of the microprocessor, if this latter register is full or if this quota is lower than the last determined quota.

When this method is used, loading of the register is quasi-linear, but possible accelerations due to idle periods of the microprocessor are not taken into account.

By a second method, upon each line return the quota of the microprocessor is determined for the next time slot, this time slot corresponding to the total duration for scanning one line; loading of the first-in/first-out register is then performed in accordance with a curve having the form $y=k(1-a^{-x})$, where in a first approximation k represents the size of a circular memory used as a line buffer register, and a is a function of the number of columns of characters and of the number k; x is a variable linked with the height of a character cell, while the result y gives the number of characters in the line buffer registers at the end of each line scanning.

In fact, it is possible to determine k and a in a first approximation, given that H is the height of a character cell, using the following resolution of the system, $$k(1-a^{-2H})=y_1$$

$$k(1-a^{-1})=y_2$$

where $Y_1$ represents the size of a circular memory used as a line buffer register, and $Y_2$ corresponds to the size of a row of characters.

This second method makes it possible to give priority to the microprocessor, if a quota is not fully used, while in return the quota is further reduced during the first time slot. It should also be noted that this solution is still more valuable if the microprocessor code is stored in a memory connected by another bus other than the single-memory bus. In that case, the microprocessor only rarely uses up its entire quota.

In practice, a circular memory with 512 words, the useful portion of which is divided into eight zones of 64 words each, can be used as the line buffer register RB. To obtain the microprocessor quota, it suffices to use the three most significant bits of the number of words in the queue in a FIFO-type register as the address of an auxiliary eight-word memory. The contents of each word is the quota that was predetermined.

Figure 3:
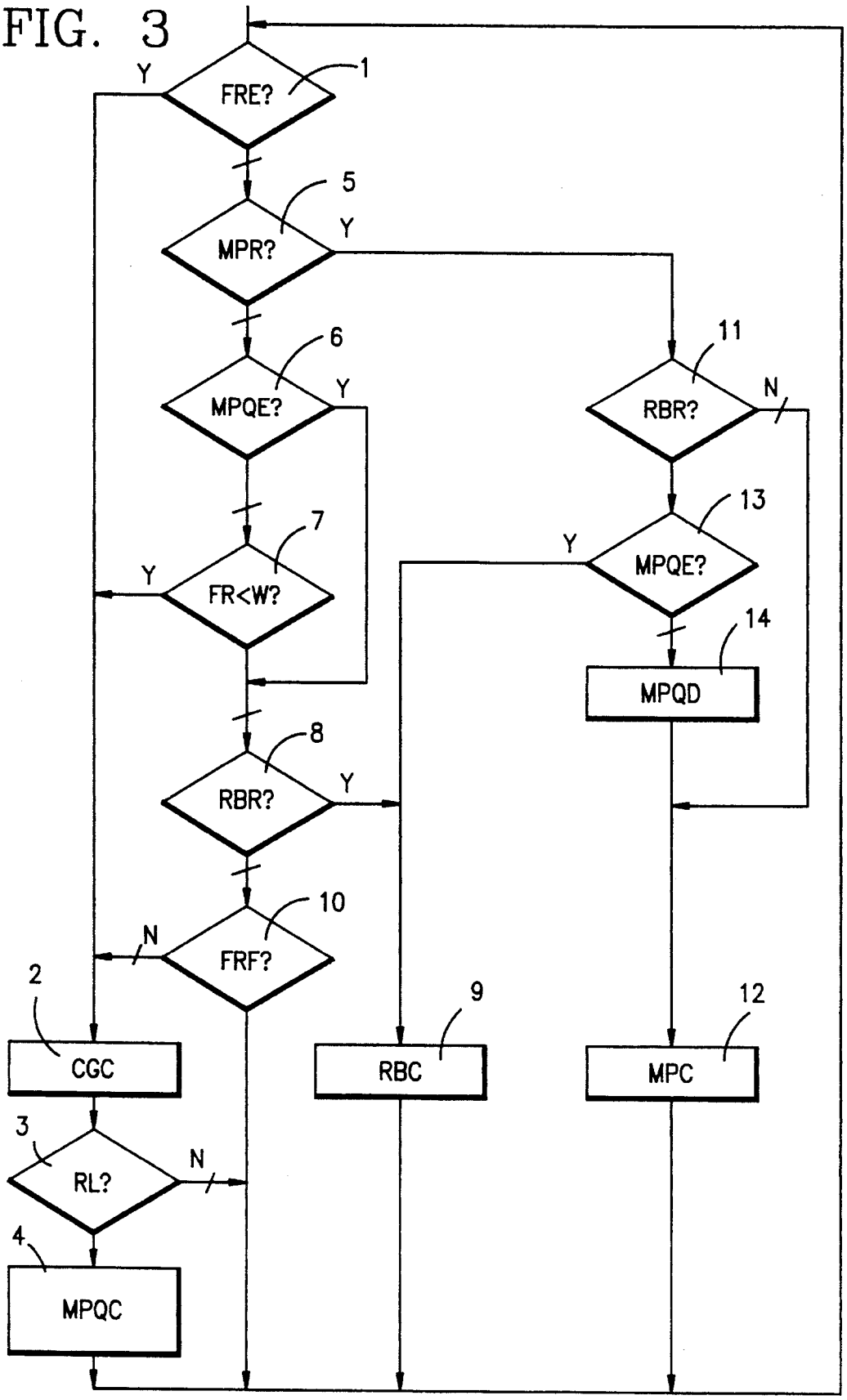
FIG. 3 shows an exemplary flow chart to illustrate the sequencing method employed by the device according to the invention.

FIG. 3 shows an example of a flow chart making it possible to illustrate the sequencing method employed by the device according to the invention, and more particularly by the microprogrammed sequencing means integrated into the specific application circuit. These sequencing means will easily be deduced by one skilled in the art once the method is understood. They are included in the environment of the microprocessor MP and are typically composed of memories and registers. The principle is as follows: execution of a task requires the prior processing of a memory access and the execution of a memory access. After each access, the task is suspended.

As has been observed above, the three tasks that must be executed by the sequencing means are as follows:

sampling in the specific zone of the memory assigned to the screen, for loading of line buffer registers;

presentation of a word of the specific zone of the memory assigned to the register of the first-in/first-out type;

meeting the respective requests for access by the microprocessor to the specific zone for the programs, by line buffer registers to the specific zone for the screen, or by the first-in/first-out-type register to the specific zone assigned to the character generator.

The allocation of the memory cycle to one of the aforementioned tasks is based on the principle of flow regulation, that is, on filling of the various registers. Accesses to the FIFO register are furnished with priority as a function of the three indications of available data for that register. The third indication, relating to the number of words W, is calculated as follows, knowing that:

Tv1 is the total duration of a video line

Tev is the duration of the useful portion of a video line

Tch is the duration of display of a character in a video line

Tmem is the duration of a memory cycle

Tcpu is the duration of a microprocessor cycle $$W=\frac{Tev}{Tcpu}-\left(\frac{Tev}{Tmem}-\frac{Tev}{Tch}\right)=Tev\left(\frac{1}{Tcpu}+\frac{1}{Tch}-\frac{1}{Tmem}\right),$$

on the condition that it is possible to change these words during the line return, in other words, if:

$$W<(Tvl-Tev)\left(\frac{1}{Tmem}-\frac{1}{Tcpu}\right).$$

According to FIG. 3, which shows the method for allocation of memory cycles, the allocation decision is based on the following:

the requests made by the microprocessor, the FIFO register, and the line buffer registers;

the three indications furnished by the FIFO register;

the state of the counter associated with access by the microprocessor.

The allocation of a memory cycle during the image return is not illustrated. In fact, in this phase there is no request on the part of the character generator, and consequently the pass band of the memory is sufficient to meet all the requests of the microprocessor and of the line buffer registers. During the image return, it suffices to know that the register FIFO is full, hence FIFO>W, and that the access quota for the microprocessor has not been used up.

The successive steps proposed in the light of FIG. 3 are as follows:

Initially, the state 1 exists, which comprises a test of indications of the FIFO register: [FRE?]=Is the register empty or nearly empty? If the response is yes (Y) a shift to state 2 occurs, which corresponds to a cycle [CGC] reserved for priority loading of the FIFO register during a memory cycle, and then a shift is made to state 3, which comprises testing the line scanning instant: [RL?]=Has the last character of a line just been loaded? If the response to the question [RL?] is no (N), then a shift is again made to state 1 and then to state 2 if the FIFO register again requires loading, and finally a shift is made to state 3, as long as a character line is not complete and the FIFO register is empty or nearly empty. If at state 3 the response is yes, the next state is the state 4, during which the quota of the microprocessor is calculated as a function of the filling of the line buffer registers: [MPQC]. A return is next made to the state 1. If in state 1 the response to [FRE?] is no, a shift is made to state 5, which corresponds to a test of the microprocessor access request: [MPR?]. If the response to [MPR?] is no, the following state 6 corresponds to a test relating to the microprocessor quota: [MPQE?]=Is the microprocessor quota exhausted? If the response to [MPQE?] is no, a shift is made to step 7, which comprises a test of the contents of the FIFO register: [FR<W?]=Is the number of words contained in FR less than W? If the response is yes (Y), the next step is state 2; the [CGC] cycle has priority again. If the response to [FR<W?] is no, the next state 8 corresponds to a test of the access request by the line buffer registers: [RBR?]. If the response to [RBR?] is yes (Y), the next state is state 9, corresponding to a priority loading cycle [RBC] of the registers RB, and then a return to the state 1 is made. If in state 8 the response to [RBR?] is no, the next state 10 is a new test of the contents of the FIFO register: [FRF?]=Is the FIFO register full? A negative response (N) reassigns priority to the CGC cycle of state 2 to make use of the available memory cycle, while a positive response causes a return to state 1: There is no request in a queue. Furthermore, when the response to the question [MPQE?] in state 6 is yes (Y) a shift is made to the test [RBR?] of state 8. Finally, if the response to the question [MPR?] of state 5 is yes (Y), and if accordingly a request for access by the microprocessor is being made, the next state 11 corresponds to a new test [RBR?]=Is there an access request by the line buffer registers as well? A negative response (N) brings about a change to the state 12, which is a cycle [MPC] reserved for executing access requested by the microprocessor. This state 12 is followed by the state 1. On the other hand, a positive response to state 11 brings about a change to the state 13, which is a new test [MPQE?]=Is the microprocessor quota exhausted? If the response is yes (Y), the next state is again state 9, corresponding to a cycle [RBC] of priority loading of the line buffer registers. Contrarily, if the response is no, the next state 14 corresponds to an operation [MPQD] of decrementation or downward counting and hence of a reduction in the quota of the microprocessor. This operation is followed by a cycle [MPC] reserved for the execution of accesses requested by the microprocessor, or in other words a return to state 12.

Some remarks of general interest relating to the employment of the method described above follow.

Each time an image begins (the FIFO register is empty, but there is sufficient time available to load it prior to effective startup of display), the transitions of the indication signal "FIFO register empty" are used to avoid blocking the microprocessor.

It is the task of filling the FIFO register, during the [CGC] cycle, that causes the reloading of the counter associated with the microprocessor at the beginning of each line.

When the sequencing method is employed, it is essential to fully use the pass band of the single memory; to do this, it is necessary to perform operations preparatory to a memory cycle during the execution of the preceding cycle, and consequently the internal processing time must be shorter than the memory access time. However, certain processing operations can overflow, for instance at the end of a line, and in that case account must be taken of this in calculating the pass band of the memory, which results in a variation of approximately 1 to 2% in the time for access to the memory.

In conclusion, taking experience and simulation into account, a single memory on the order of 15% faster than the memory of the prior art normally intended for the character generator must be used. By adding to this memory a FIFO register that enables spreading out the reading of the character generator, line buffer registers that enable decreasing the throughput occasioned by reading of the zone assigned to the screen, and a small-sized cache memory that makes it possible to improve the success rate and to reduce the load occasioned by the microprocessor, the pass band of the memory becomes sufficient to meet the needs of the microprocessor and of the video portion.

What is claimed is:

1. A data input/output device for the display of video information, comprising a microprocessor, memorizing means, and a video portion monolithically integrated in an application specific integrated circuit and operatively connected via bus lines, said microprocessor including programs therein, said memorizing means including a single memory having three specific zones for storing data relating respectively to said programs of said microprocessor, to the video information to be displayed, and to information for character generation, wherein a single memory bus is connected with said single memory and provides access authorization to said three specific zones, said access authorization being administered by a sequencing method employed by microprogrammed sequencing means for the distribution of memory cycles and regulation of the flow of data within said memorizing means, said memorizing means including intermediate memory means for use by said microprogrammed sequencing means in regulating said flow of data within said memorizing means.

2. The data input/output device as defined by claim 1, wherein said memorizing means further includes, a small-sized cache memory (CM) connected between said microprocessor (MP) and said single memory (M) via said single-memory bus (MB).

3. The data input/output device as defined by claim 1, wherein the memorizing means further includes a register (FR) of the first-in/first-out type connected between said video portion and said single memory via said single-memory bus.

4. The data input/output device as defined by claim 3, wherein said register (FR) of the first-in/first-out type is operable to provide three indications relating to its state: register full, register substantially empty, and the number of words in said register less than W, W being the number of words that must be accumulated in the register to be capable of meeting all requests of the microprocessor during a given time period.

5. The data input/output device as defined by claim 1, wherein said memorizing means further includes at least two line buffer registers (RB) connected between said video portion and said single memory via said single-memory bus.

6. The data input/output device as defined by claim 2, wherein the memorizing means further include at least two line buffer registers (RB) connected between said video portion and said single memory via said single-memory bus.

7. The data input/output device as defined by claim 2, wherein the memorizing means further includes a register of the first-in/first-out type connected between said video portion and said single memory via said single-memory bus.

8. The data input/output as defined by claim 7, wherein said register (FR) of the first-in/first-out type is operable to provide three indications relating to the state of the first-in/first-out register, namely:

register full, register substantially empty, and the number of words in the register less than W, W being the number of words that must be accumulated in the register to be capable of meeting all the requests of the microprocessor during a given time period.

9. The data input/output device as defined by claim 7, wherein said memorizing means further include at least two line buffer registers (RB) connected between said video portion and said single memory via said single-memory bus.

10. The data input/output device as defined by claim 8, wherein said memorizing means further include at least two line buffer registers (RB) connected between said video portion and said single memory via said single-memory bus.

11. The data input/output device as defined by claim 4, wherein said memorizing means further include at least two line buffer registers (RB) connected between said video portion and said single memory via said single-memory bus.

12. The data input/output device as defined by claim 3, wherein the memorizing means further include at least two line buffer registers (RB) connected between said video portion and said single memory via the single-memory bus.

13. A sequencing method for the distribution of memory cycles and regulation of the flow of data inside a memorizing means of a data input/output device for the display of information on a video screen of a video terminal having a line scanning frequency and developed around a microprocessor having programs therein with the memorizing means having first, second and third memory zones being dedicated respectively to the programs of the microprocessor, the video screen and a character generator comprising the steps of allocating a memory cycle in synchronism with the line scanning frequency of the video terminal after executing a series of tests to determine priority for executing various tasks, said step of executing a series of tests including sampling in said second memory zone assigned to the video screen of the video terminal for loading line buffer registers in the memorizing means, presenting a word from said third memory zone dedicated to the character generator to a first in/first-out type register, directing any request for access by the microprocessor to said first zone for programs of the microprocessor, by the line buffer registers to said second zone for the video screen, and by the first-in/first-out type register to said third zone dedicated to the character generator, respectively.

14. A sequencing method for the distribution of memory cycles and regulation of the flow of data inside a memorizing means of a data input/output device for the display of information on a video screen of a video terminal having a line scanning frequency and developed around a microprocessor having programs therein with the memorizing means having first, second and third memory zones being dedicated respectively to the programs of the microprocessor, the video screen and a character generator comprising the steps of allocating a memory cycle in synchronism with the line scanning frequency of the video terminal after executing a series of tests to determine priority for executing various tasks, said step of executing a series of tests including sampling in said second memory zone assigned to the video screen of the video terminal for loading line buffer registers in the memorizing means, presenting a word from said third memory zone dedicated to the character generator to a first-in/first-out type register, directing any request for access by the microprocessor to said first zone for programs of the microprocessor, by the line buffer registers to said second zone for the video screen, and by the first-in/first-out type register to said third zone dedicated to the character generator, respectively, wherein the allocation of the memory cycles is effected following execution of the series of tests taking into account requests by the microprocessor and a computed access quota assigned to said microprocessor, requests by the character generator and requests by the line buffer registers, three indications relating to filling of the first-in/first-out type register, and finally the state of a counter associated with access to the microprocessor, and utilizing the results of the tests in such a way that:

the first-in/first-out register is loaded with priority over other loading requests as long as said register is substantially empty, and;

if the first-in/first-out register is not substantially empty, accesses by the microprocessor have priority, as long as said access quota assigned to the microprocessor has not been exhausted, knowing that furthermore a cycle is not counted in said access quota unless the line buffer registers are not full;

filling of the line buffer registers has priority with respect to filling of the first-in/first-out register if the number of words in a queue in the first-in/first-out register is greater than W, W being the number of words that must be accumulated in the register to be capable of meeting all requests of the microprocessor during a useful portion of line scanning of the video screen, or if said access quota assigned to the microprocessor is exhausted and the first-in/first-out register is not substantially empty.

15. The sequencing method as defined by claim 14, characterized in that the access quota assigned to the microprocessor, once determined, remains valid until the first-in/first-out register is full or until a lower quota is required to guarantee loading of the line buffer registers, wherein upon each line return, the quota, which is determined as a function of the filling of the first-in/first-out register, becomes the effective quota of the microprocessor, if this latter register is full or if this quota is less than the latter determined quota.

16. The sequencing method as defined by claim 14, characterized in that the access quota assigned to the microprocessor is determined, upon each line return, for the next time slot, the time slot corresponding to the total duration of scanning of one line, the loading of the first-in/first-out register then being performed in accordance with a curve having the form $y=k(1-a^{-x})$, where in a first approximation k represents the size of a circular memory used as a line buffer register, and a is a function of the number of columns of characters and of the number k, x being a variable linked with the height of a character cell, while the result y gives the number of characters in the line buffer registers at the end of each line scanning.

* * * * *